US010843206B2

(12) United States Patent
Liu et al.

(10) Patent No.: US 10,843,206 B2
(45) Date of Patent: Nov. 24, 2020

(54) CYLINDRICAL IFD FILTER

(71) Applicant: Tianjin University, Tianjin (CN)

(72) Inventors: Junjie Liu, Tianjin (CN); Zhiwei Zhang, Tianjin (CN); Wenhua Chen, Tianjin (CN)

(73) Assignee: Tianjin University, Tianjin (CN)

( * ) Notice: Subject to any disclaimer, the term of this patent is extended or adjusted under 35 U.S.C. 154(b) by 0 days.

(21) Appl. No.: 15/571,503

(22) PCT Filed: Apr. 26, 2017

(86) PCT No.: PCT/CN2017/081957
§ 371 (c)(1),
(2) Date: Nov. 2, 2017

(87) PCT Pub. No.: WO2018/028248
PCT Pub. Date: Feb. 15, 2018

(65) Prior Publication Data

US 2019/0126289 A1 May 2, 2019

(30) Foreign Application Priority Data

Aug. 11, 2016 (CN) ..... 2016 1 0668092

(51) Int. Cl.
*B03C 3/06* (2006.01)
*B03C 3/41* (2006.01)
*B03C 3/49* (2006.01)

(52) U.S. Cl.
CPC ..... *B03C 3/06* (2013.01); *B03C 3/41* (2013.01); *B03C 3/49* (2013.01); *B03C 2201/04* (2013.01); *B03C 2201/10* (2013.01)

(58) Field of Classification Search
CPC combination set(s) only.
See application file for complete search history.

(56) References Cited

U.S. PATENT DOCUMENTS 895,729 A * 8/1908 Cottrell ..... B03C 3/017 313/311
1,931,436 A * 10/1933 Deutsch ..... B03C 3/36 313/243

(Continued)

FOREIGN PATENT DOCUMENTS

CN 204404405 U 6/2015
CN 204739693 U 11/2015

(Continued)

*Primary Examiner* — Christopher P Jones
*Assistant Examiner* — Sonji Turner
(74) *Attorney, Agent, or Firm* — George G. Wang; Bei & Ocean

(57) ABSTRACT

The present invention discloses a cylindrical IFD filter, comprising a dust collecting module and a field power module interval arranged inside the channel of the dust collecting module, a plurality of field power module units are symmetrically and vertically spaced arranged on the side wall of the field power module; a plurality of layers of the dust collecting module channels which are stacked vertically are pass-through arranged on the dust collecting module, and each barrier wall between the vertical adjacent dust collecting module channels is alternately disposed as a pair of positive plate and negative plate, each barrier wall between the vertical adjacent dust collecting module channels comprises polar plate electrode and a polar plate coating coated on the upper and bottom walls of the polar plate electrode; and each barrier wall between the lateral adjacent dust collecting module channels adopts same coating material as the polar plate coating. The present invention has the advantages of having larger particulate contaminant charge and higher filtering efficiency.

7 Claims, 14 Drawing Sheets

(56) References Cited

U.S. PATENT DOCUMENTS 2,776,724 A * 1/1957 Goldschmied ..... B03C 3/10 96/55
3,915,676 A * 10/1975 Reed ..... B03C 3/155 55/304
4,018,578 A * 4/1977 Ahlrich ..... B03C 3/09 96/78
4,093,432 A * 6/1978 Ahlrich ..... B03C 3/09 96/78
4,623,365 A * 11/1986 Bergman ..... B03C 3/155 55/498
4,904,283 A * 2/1990 Hovis ..... B03C 3/155 96/66
4,922,099 A * 5/1990 Masuda ..... B03C 7/04 250/324
4,941,962 A * 7/1990 Inoue ..... B01D 53/323 204/639
5,402,639 A * 4/1995 Fleck ..... B01D 53/92 422/180
5,797,978 A * 8/1998 Rosenberg ..... B01D 46/12 95/74
6,228,148 B1 * 5/2001 Aaltonen ..... B03C 3/15 55/431
6,334,982 B1 * 1/2002 Carlow ..... B01J 19/088 422/186.04
6,391,097 B1 * 5/2002 Rosenberg ..... B01D 29/46 210/492
6,773,489 B2 * 8/2004 Dunn ..... B03C 3/09 209/127.1
6,918,951 B2 * 7/2005 Rosenberg ..... B03C 3/155 96/60
7,105,041 B2 * 9/2006 Dunn ..... B03C 3/09 96/66
7,651,553 B2 * 1/2010 Pletcher ..... B03C 3/41 264/104
7,862,650 B2 * 1/2011 Dooley ..... B03C 3/09 96/67
8,345,895 B2 1/2013 Chen
8,894,745 B2 * 11/2014 Dunn ..... B03C 3/12 95/70
9,039,815 B2 * 5/2015 Dunn ..... B03C 3/41 96/70
9,073,062 B2 * 7/2015 Dunn ..... B03C 3/47
9,180,466 B2 * 11/2015 Liu ..... B03C 3/06
9,238,230 B2 * 1/2016 Dunn ..... B03C 3/45
10,166,548 B2 * 1/2019 You ..... B03C 3/40
2005/0028676 A1 * 2/2005 Heckel ..... B03C 3/38 96/95
2013/0056297 A1 3/2013 Chen
2016/0123735 A1 5/2016 Gregory et al.

FOREIGN PATENT DOCUMENTS

CN 205217135 U 5/2016
CN 106076625 A 11/2016
CN 205926011 U 2/2017
DE 146625 B1 6/1983
JP H0226653 A 1/1990

* cited by examiner

CYLINDRICAL IFD FILTER

TECHNICAL FIELD

The present invention relates to the technical field of ventilation and purification, and in particular to a cylindrical IFD (hereinafter referred to as Intense Field Dielectric) filter.

BACKGROUND OF THE PRESENT INVENTION

With the rapid improvement of our living standards, indoor air quality (hereinafter referred to as IAQ) is receiving more and more attention because the IAQ directly affects our health and living comfort. Due to the increased sources and types of indoor contaminants, increased airtightness of buildings and increased touch opportunities between indoor people and contaminants, the use of air purification and ventilation devices can effectively improve the IAQ. In recent years, smog, dust storms and other environmental issues become increasingly worse, which puts forward higher requirements for the air purification and ventilation system.

The IFD, that is Intense Field Dielectric, refers to a strong electric field by using dielectric materials as the carrier. The dielectric materials form a cellular-shaped micro channel and wrap the electrode pads to form a strong electric field in the channel. The IFD exerts a strong attraction to the charged particles in the air, and can absorb almost 100% airborne particles whilst generating minimum airflow impedance, which is especially effective in removing PM2.5 and other particulate contaminants. Furthermore, the IFD, with high efficiency sterilization function, can collect the bacteria and microorganism which are attached on the particles and kill them in the intense field.

The Chinese Utility Model Patent CN104697103A disclosed a fresh air ventilator with an electrostatic dust collection function, including a housing, an air inlet pipeline, an air exhausting pipeline, a heat exchanging core and a filtering assembly, wherein the filtering assembly comprises an IFD dust collection plate and an ozone adsorption plate. The above patent has the defects of: 1) the IFD charge module and the IFD filter screen are of plate structure, which limits the application; 2) the filtering efficiency of the filtering assembly is declined rapidly over time.

The Chinese Utility Model Patent CN204404405U disclosed a blowing-type air purifying device of a microelectrostatic central air conditioner, comprising a housing, a primary-effect filter screen, a field power module and an IFD module. The above patent has the defects of: 1) the field power module and the IFD module are of plate structure, which limits the application; 2) the filtering efficiency is declined rapidly over time.

The Chinese Utility Model Patent CN204739693U disclosed an IFD purifier of four-side air-out VRV air conditioner, which comprises a housing, an air inlet, air outlets, primary-effect module, an IFD purification unit and an air quality monitoring module. The above patent has the defects of: 1) the fan and the IFD purification unit are arranged independently of each other, thus having poor air distribution and high resistance; 2) the IFD purification unit is of plate structure, which limits the utilization with the fan; 3) the filtering efficiency of the IFD purification unit is declined rapidly over time.

The Chinese people generally concerns IAQ and takes it as a prominent problem of people's livelihood because the IAQ is involved with the health and vital interests of hundreds of millions of Chinese people. For improving the residence and workplace air quality, it is required to provide a ventilation device with filtering performance. Referring to the air ventilation and purification technique for the past few years in China and abroad, it is confronted with the following challenges: 1) comfort: the indoor ventilation system should meet the requirements of low noise and having controllable air distribution, and can perform purification and hydrothermal treatment to the fresh air when the outdoor air quality is declined; 2) safety: the air ventilation and purification system should not produce harmful by-products while treating air; 3) high efficiency: the air ventilation and purification system should capable of continuously and efficiently treat with air pollutants and easy maintenance; 4) intelligence: the air ventilation and purification system should capable of smartly regulating the operation of the system according to indoor and outdoor air quality to satisfy the IAQ in different conditions; 5) appearance: the air ventilation and purification system should capable of satisfying the function of ventilation and purification whilst not breaking aesthetics and integrity of the internal and external of the buildings.

SUMMARY OF THE PRESENT INVENTION

The present invention aims to overcome the deficiencies in the prior art and provides a cylindrical IFD filter which can stepped increase the filtering efficiency and has low attenuation and can achieve inlet air incoming from the middle and outlet air exhausting from the periphery.

To achieve the above objectives, the present invention provides a cylindrical IFD filter, comprising a dust collecting module and a field power module interval arranged inside the channel of the dust collecting module, the dust collecting module and the field power module, which have same height and the cross-section of which are of ring shape, are supported on an insulating plate in coaxial manner; a plurality of field power module units are symmetrically and vertically spaced arranged on the side wall of the field power module; each field power module unit comprises a discharge electrode conductive ring and a plurality of discharge cavities having the same height, each discharge cavity is pass-through arranged on the side wall of the field power module, each discharge electrode conductive ring is arranged on the plurality of discharge cavities of each field power module unit; a discharge electrode is welded on said discharge electrode conductive ring in response to the middle portion of each discharge cavity, and each discharge electrode is inserted into the corresponding discharge cavity; the discharge electrode conductive rings of a plurality of field power module unit are connected with each other via metal rods to form the field power module cathode, and the side wall of the field power module communicates with the metal rods or wires to form the field power module anode; a plurality of layer of the dust collecting module channels which are stacked vertically are pass-through arranged on the dust collecting module, each layer of the dust collecting module channels comprises a plurality of dust collecting module channels which are lateral connected sequentially, the dust collecting module channels in the plurality of layers of the dust collecting module channels are vertically aligned; and each dust collecting module channel is of fan-shape, wherein the cross-sectional area of the dust collecting module channel is gradually increased along the direction from the air inlet of the dust collecting module channel to the air outlet thereof, and the air inlet and air outlet of the dust collecting module channel are of arc shape; and each barrier wall between the vertical adjacent dust collecting module channels is alternately disposed as a pair of positive and negative plate, all the positive plates are connected with each other via wires to form the anode, and all the negative plates are connected with each other via wires to form the cathode; a plurality of the dust collecting module anodes are connected with the first wire, and a plurality of the dust collecting modules cathode are connected with the second wire; and each barrier wall between the vertical adjacent dust collecting module channels comprises polar plate electrode and a polar plate coating coated on the upper and bottom walls of the polar plate electrode, the barrier walls between the lateral adjacent dust collecting module channels adopt same coating material as the polar plate coating.

The present invention, compared to the prior art, has the advantages of:

(1) having larger particulate contaminant charge and higher filtering efficiency;

(2) along air flow direction, the cross-sectional area of the dust collecting module channels is gradually increased and air flow speed is slower, and the filtering efficiency will improve gradually if the dust collecting voltage does not change, which is more significant for small particles;

(3) the filtering efficiency of the filtering assembly is declined slowly over time;

(4) applying for the air purifying device having the function of inlet air incoming from the middle and outlet air exhausting from the periphery, thus expands the application scope of the air purifying device;

(5) the field power module and the dust collecting module can be self-designed to satisfy the actual requirements.

DETAILED DESCRIPTION OF THE PRESENT INVENTION

Figure 1:
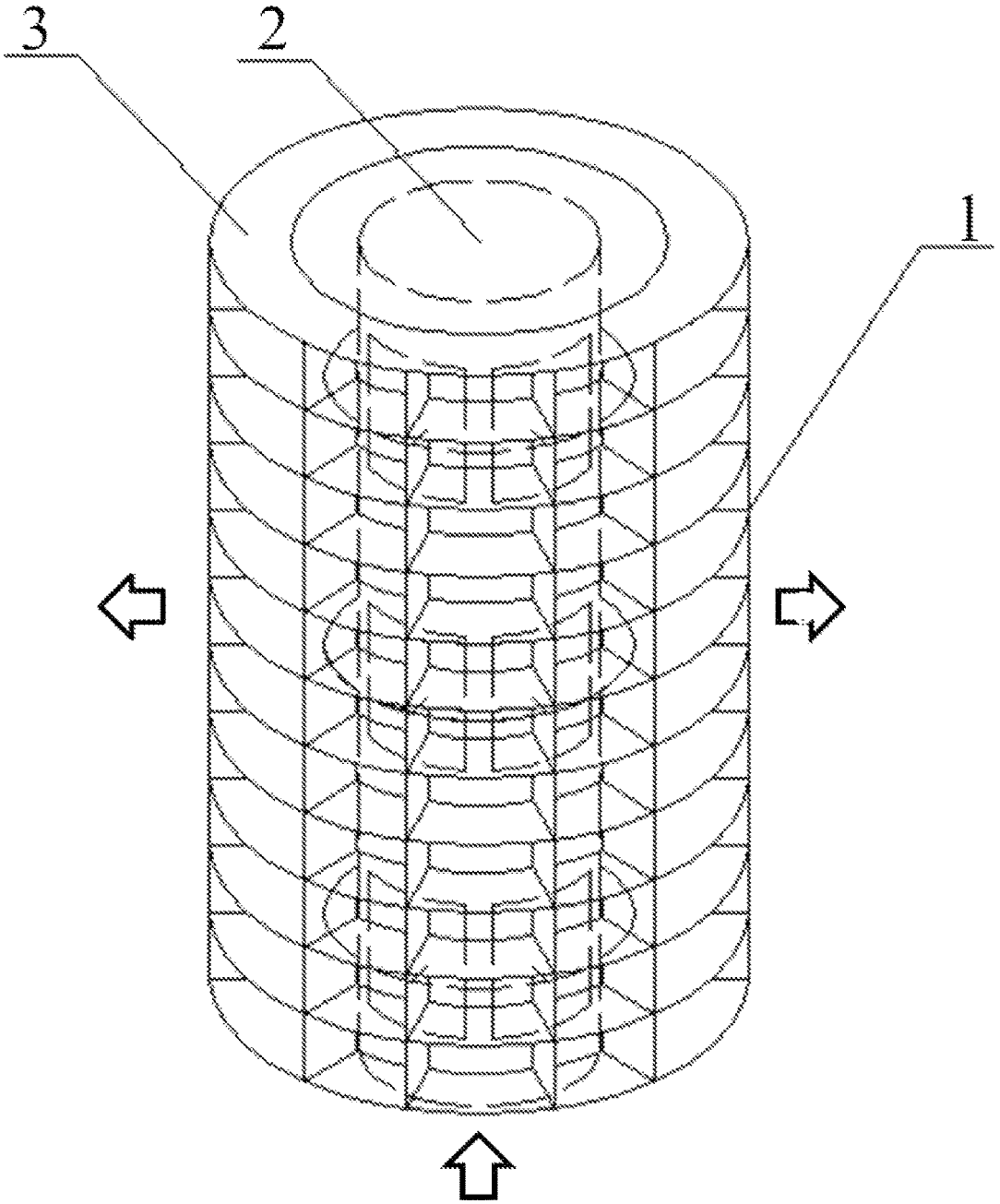
FIG. 1 is a structural diagram of the cylindrical IFD filter according to Embodiment 1 of the present invention.

The present invention will be further described below with reference to the accompanying drawings and embodiments.

As shown in the figures, a cylindrical IFD filter 1 of the present invention comprises a dust collecting module 3 and a field power module 2 interval arranged inside the channel of the dust collecting module 3, the dust collecting module 3 and the field power module 2, which have same height and the cross-section of which are of ring shape, are supported on an insulating plate in coaxial manner. A plurality of field power module units 6 are symmetrically and vertically spaced arranged on the side wall of the field power module 2; each field power module unit 6 comprises a discharge electrode conductive ring 6-3 and a plurality of discharge cavities 6-1 having the same height, each discharge cavity is pass-through arranged on the side wall of the field power module 2, each discharge electrode conductive ring 6-3 is arranged on the plurality of discharge cavities 6-1 of each field power module unit 6; a discharge electrode 6-2 is welded on said discharge electrode conductive ring 6-3 in response to the middle portion of each discharge cavity 6-1, and each discharge electrode 6-2 is inserted into the corresponding discharge cavity 6-1. The discharge electrode conductive rings 6-3 of a plurality of field power module unit 6 are connected with each other via metal rods to form the field power module cathode 5, and the side wall of the field power module 2 communicates with the metal rods or wires to form the field power module anode 4; the field power module anode 4 and the cathode 5 communicate with high voltage power supply (hereinafter referred to as HVPS) of the field power module when in use, and the HVPS provides DC or pulse supply. The discharge electrodes 6-2 may be acicular shape or spiked shape, and the discharge cavities 6-1 may be round, square or rounded square shape.

A plurality of layers of the dust collecting module channels 9 which are stacked vertically are pass-through arranged on the dust collecting module 3, each layer of the dust collecting module channels 9 comprises a plurality of dust collecting module channels 9 which are lateral connected sequentially, the dust collecting module channels 9 in the layers of the dust collecting module channels 9 are vertically aligned; and each dust collecting module channel 9 is of fan-shape, wherein the cross-sectional area of the dust collecting module channel 9 is gradually increased along the direction from the air inlet 9-1 of the dust collecting module channel to the air outlet 9-2 thereof, and the air inlet 9-1 and air outlet 9-2 of the dust collecting module channel 9 are of arc shape; and each barrier wall between the vertical adjacent dust collecting module channels 9 is alternately disposed as a pair of positive plate 9-3 and negative plate 9-4, all the positive plates 9-3 are connected with each other via wires to form the dust collecting module anode 7, and all the negative plates 9-4 are connected with each other via wires to form the dust collecting module cathode 8; a plurality of the dust collecting module anodes 7 are connected with the first wire, and a plurality of the dust collecting module cathodes are connected with the second wire; each barrier wall 9-6, such as the barrier wall of the positive plate 9-3 and the barrier wall of negative plate 9-4 as shown in the figures, between the vertical adjacent dust collecting module channels 9 comprises a polar plate electrode 9-6-2 and a polar plate coating 9-6-1 coated on the upper and bottom walls of the polar plate electrode 9-6-2; the dust collecting module anode 7 and the cathode 8 communicate with HVPS of the dust collecting module when in use, and the HVPS provides DC or pulse supply. The material of said polar plate electrode 9-6-2 is selected from copper, steel, aluminum, etc., and the material of the polar plate coating 9-6-1 is selected from PVC, PTFE, ceramic, etc., and each barrier wall 9-5 between the lateral adjacent dust collecting module channels 9 adopts same coating material as the polar plate coating 9-6-1.

The discharge electrode conductive ring 6-3 is sleeved on the field power module 2 in the embodiment 1, which also can be arranged as shown in FIGS. 9 to 13 for another embodiment, the structure of another embodiment is similar to the embodiment 1, with only one difference that the discharge electrode conductive ring 6-3 is arranged inside the field power module 2.

Figure 2:
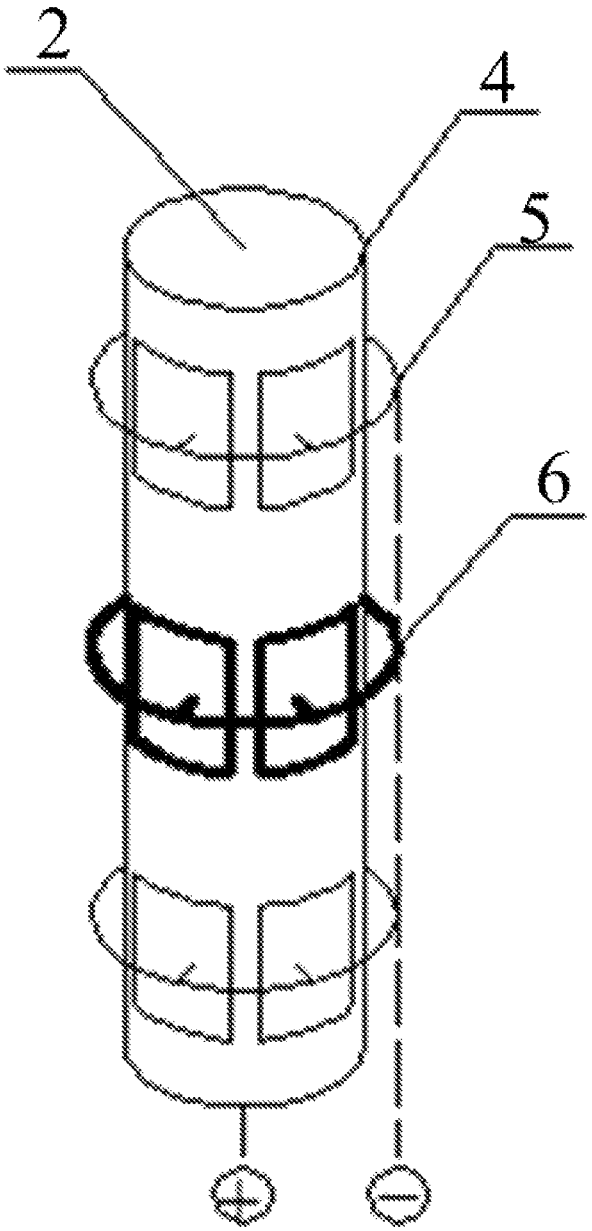
FIG. 2 is a structural diagram of the field power module of the cylindrical IFD filter according to Embodiment 1 of the present invention.
Figure 3:
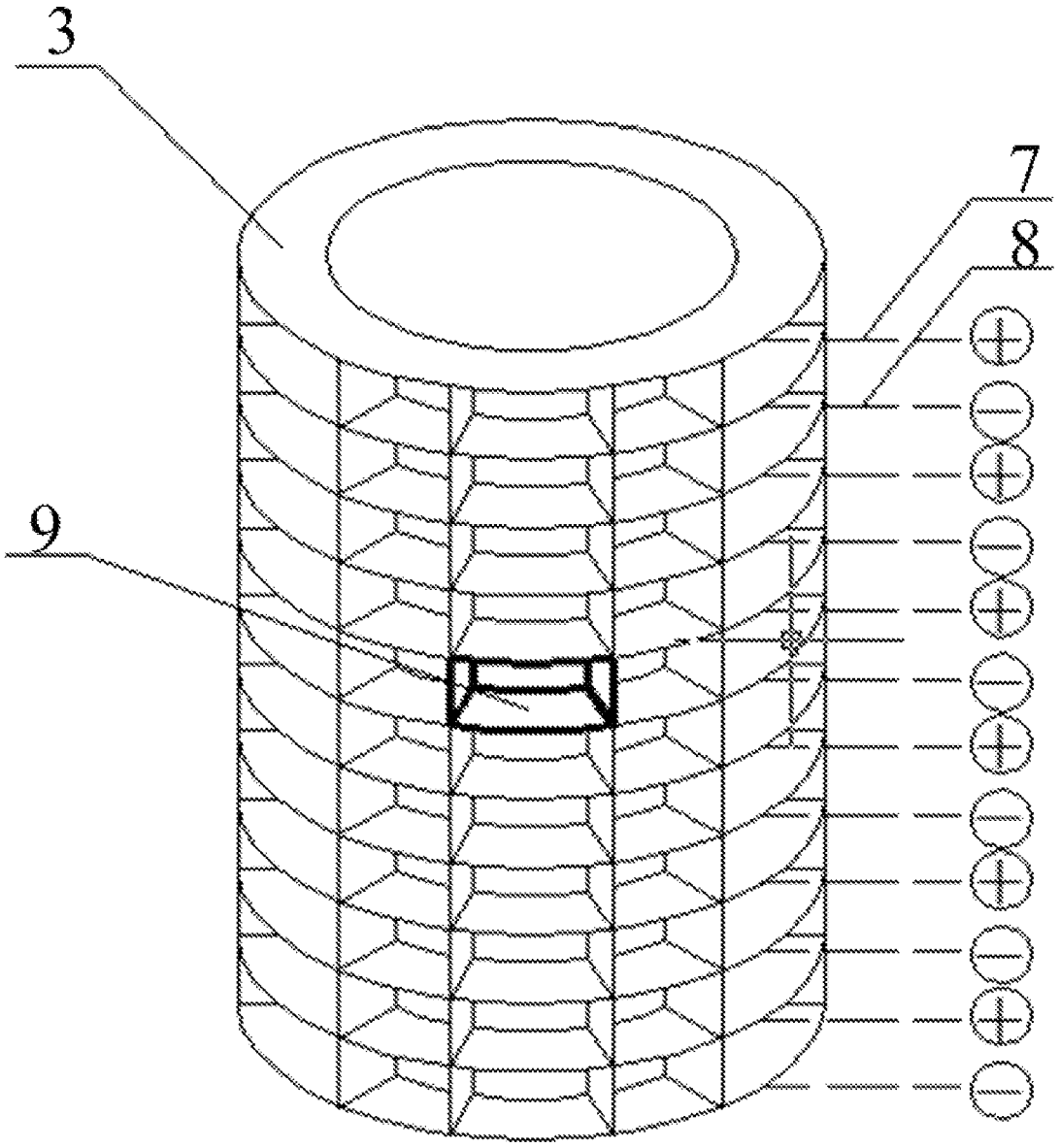
FIG. 3 is a structural diagram of the dust collecting module of the cylindrical IFD filter according to Embodiment 1 of the present invention.
Figure 4:
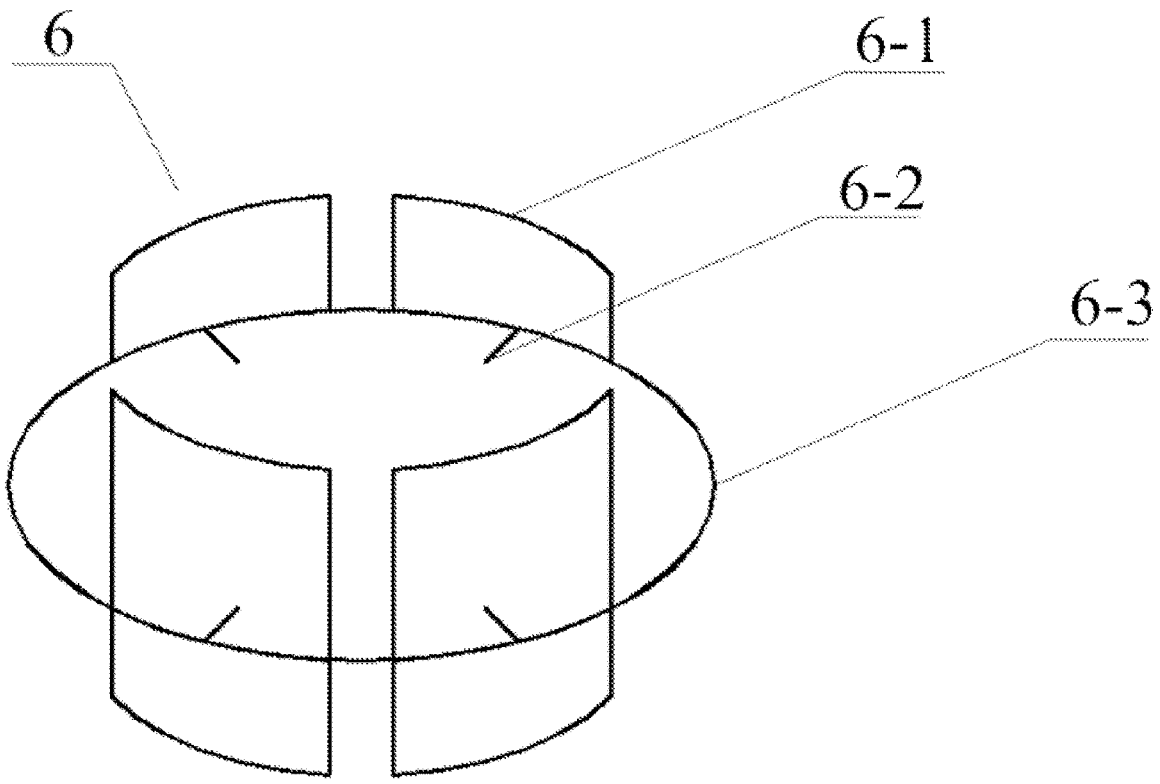
FIG. 4 is a structural diagram of the field power module unit of the cylindrical IFD filter according to Embodiment 1 of the present invention.
Figure 5:
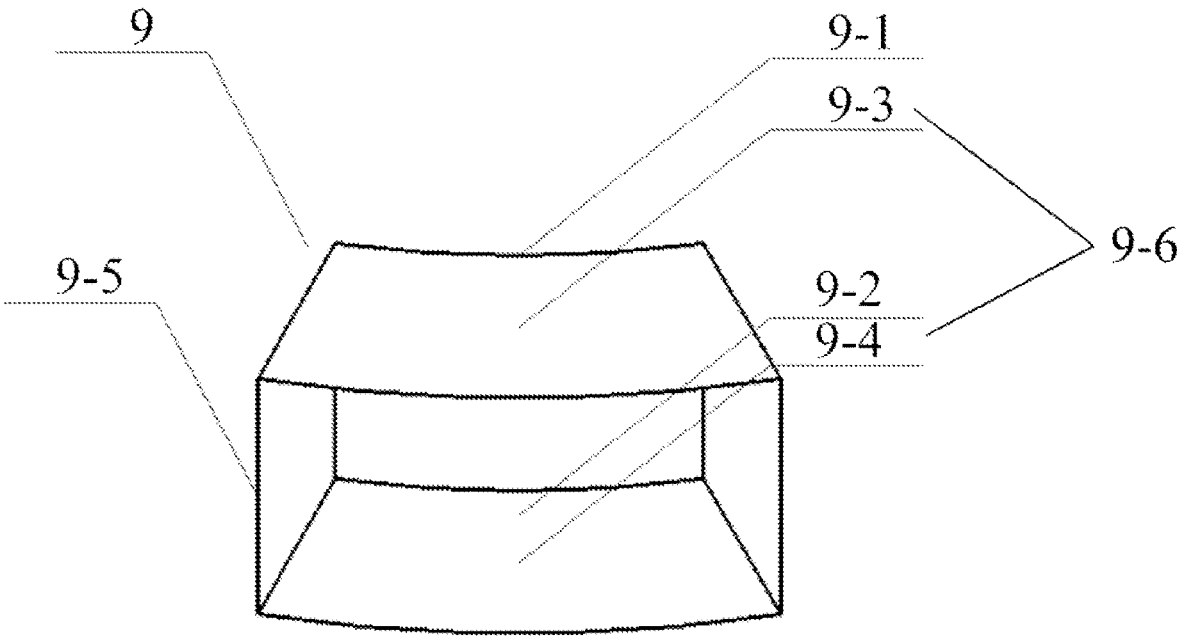
FIG. 5 is a structural diagram of the dust collecting module channel of the cylindrical IFD filter according to Embodiment 1 of the present invention.
Figure 6:
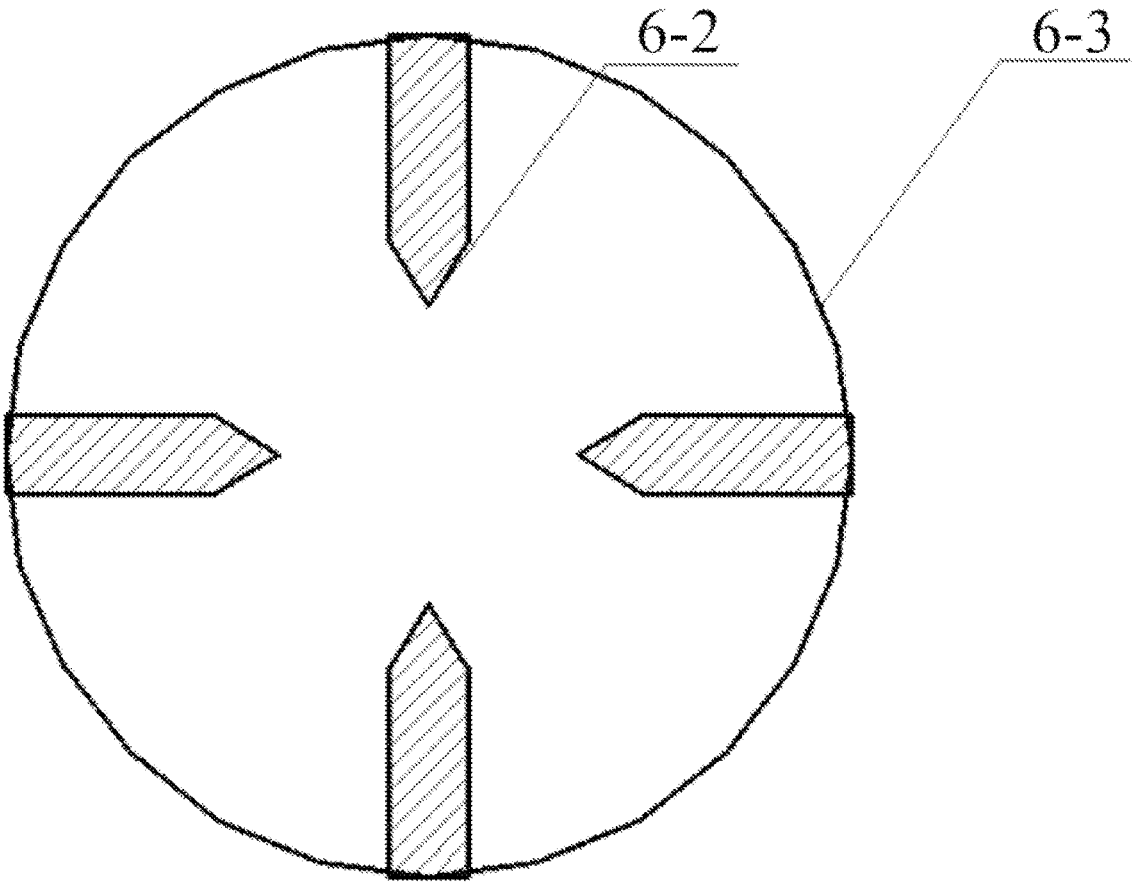
FIG. 6 is a structural diagram of the discharge electrode of the cylindrical IFD filter according to Embodiment 1 of the present invention.
Figure 7:
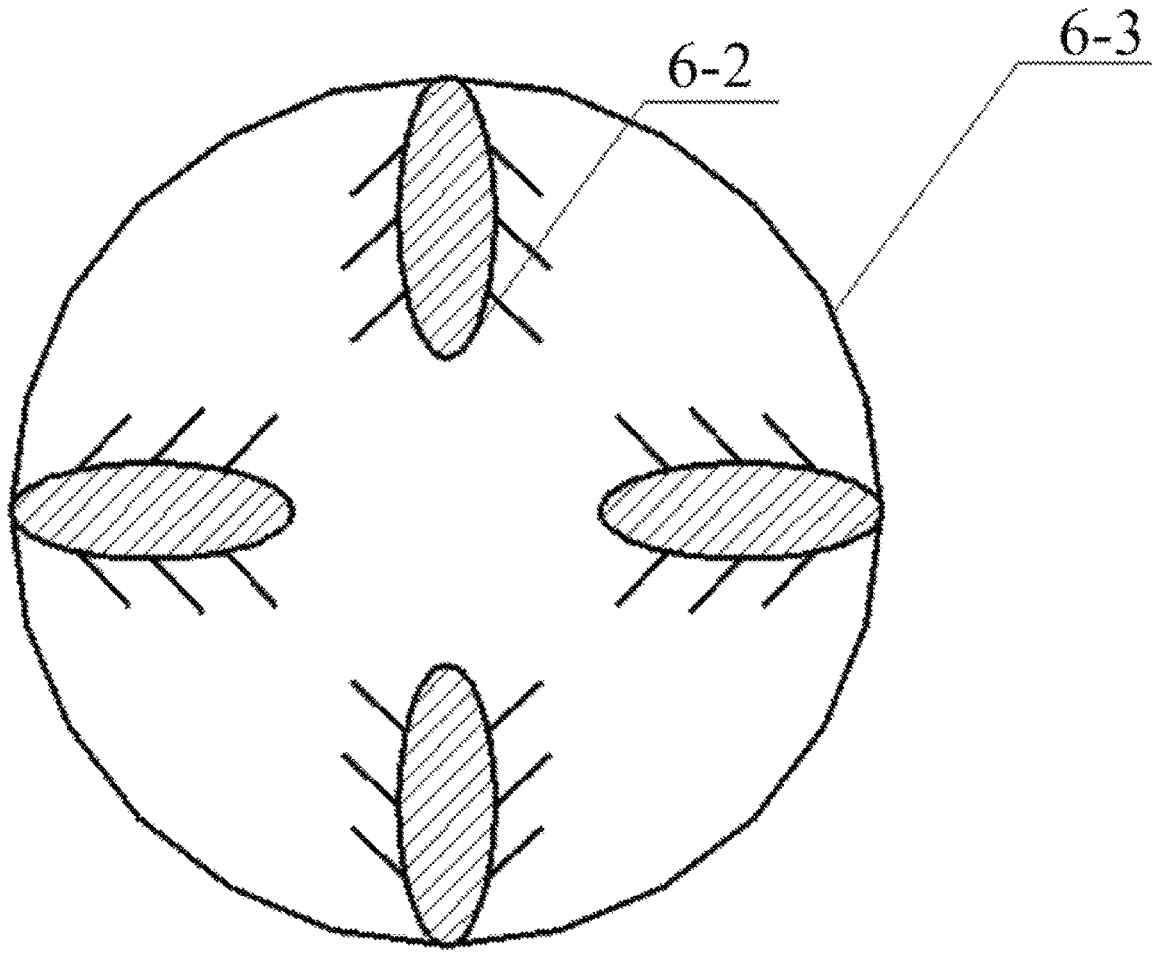
FIG. 7 is another structural diagram of the discharge electrode of the cylindrical IFD filter according to Embodiment 1 of the present invention.
Figure 8:
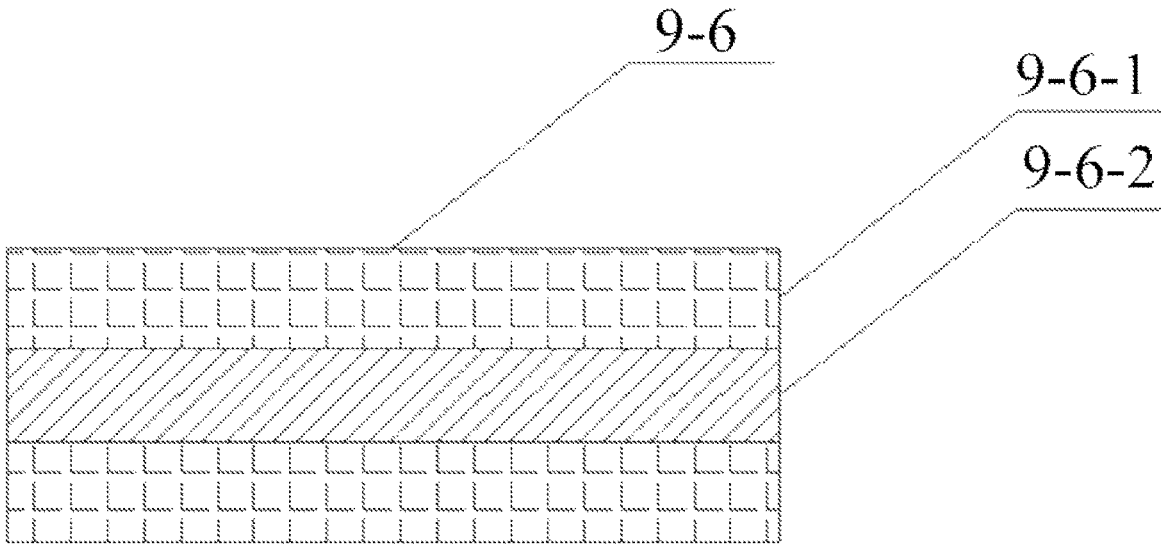
FIG. 8 is a structural diagram of the polar plate of the cylindrical IFD filter according to Embodiment 1 of the present invention.
Figure 9:
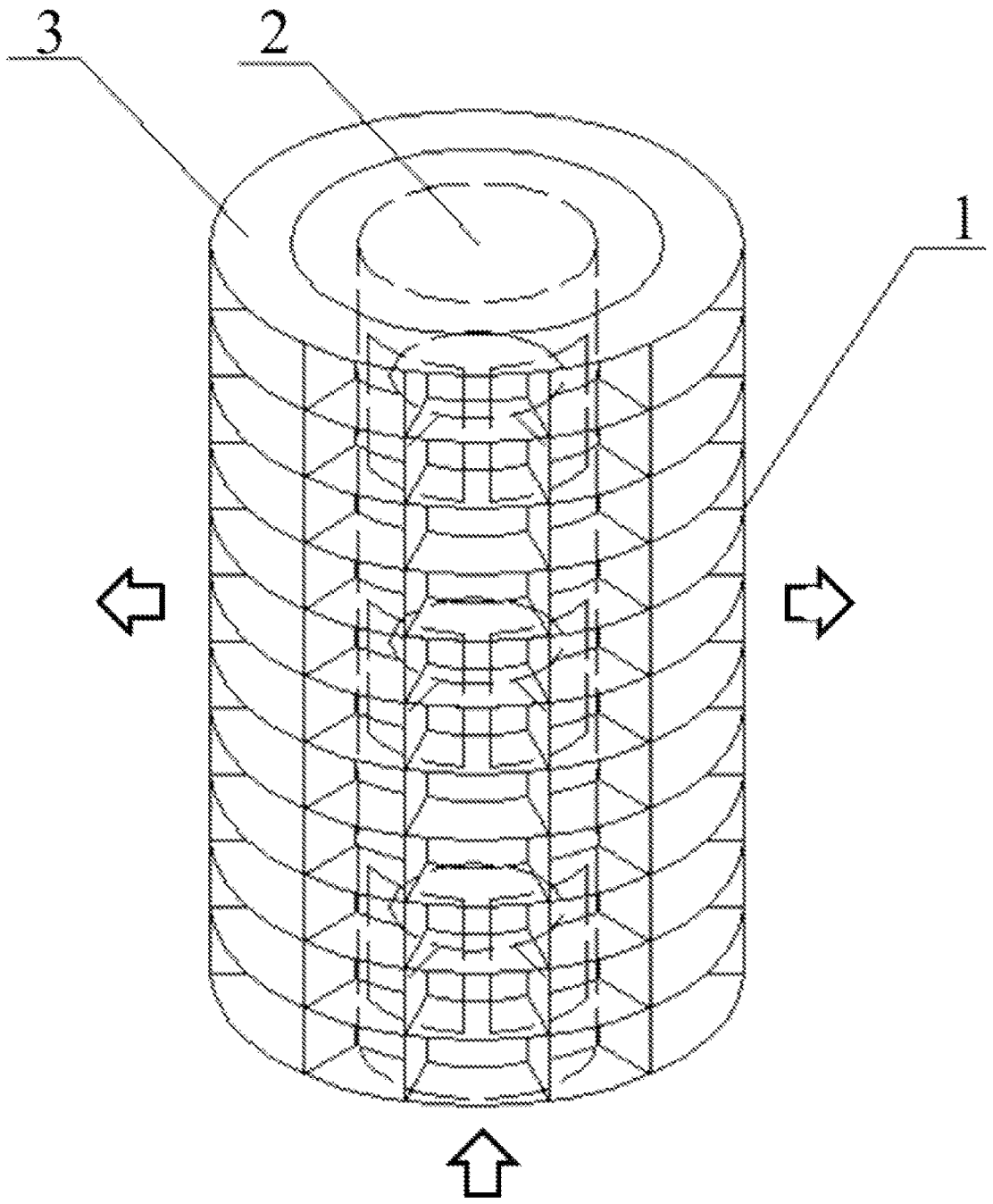
FIG. 9 is a structural diagram of the cylindrical IFD filter according to Embodiment 2 of the present invention.
Figure 10:
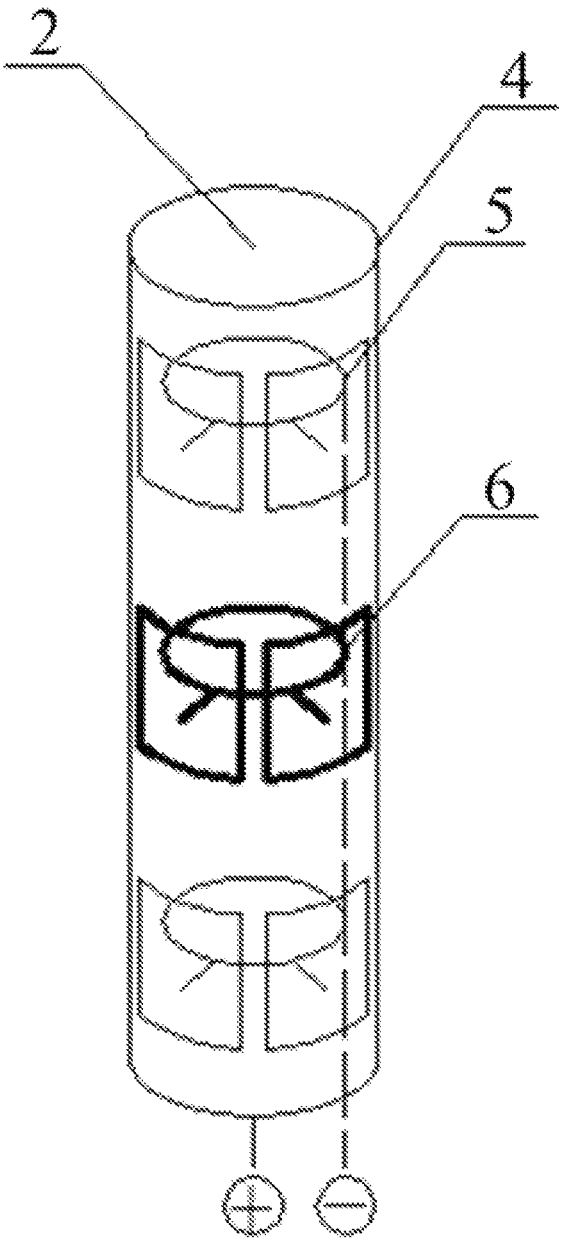
FIG. 10 is a structural diagram of the field power module of the cylindrical IFD filter according to Embodiment 2 of the present invention.
Figure 11:
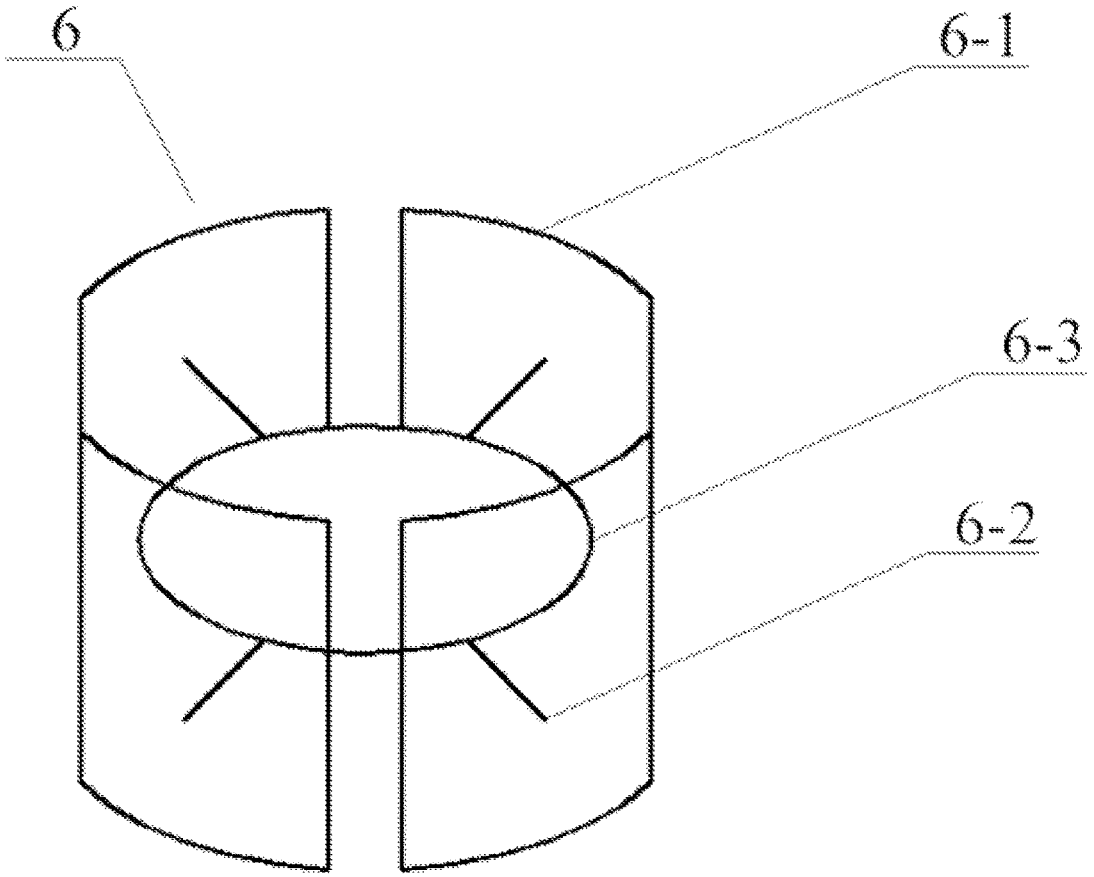
FIG. 11 is a structural diagram of the field power module unit of the cylindrical IFD filter according to Embodiment 2 of the present invention.
Figure 12:
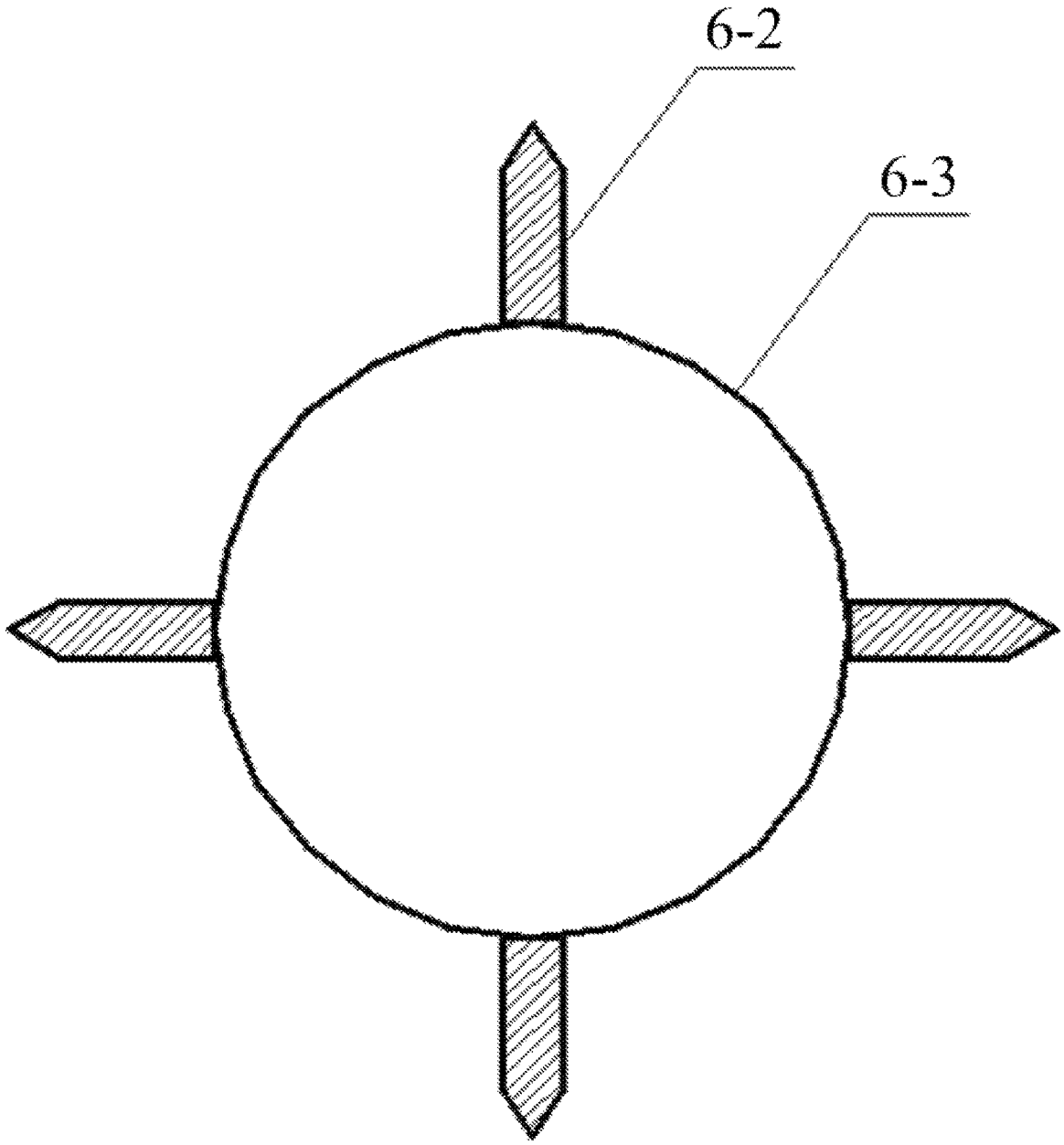
FIG. 12 is a structural diagram of the discharge electrode of the cylindrical IFD filter according to Embodiment 2 of the present invention.
Figure 13:
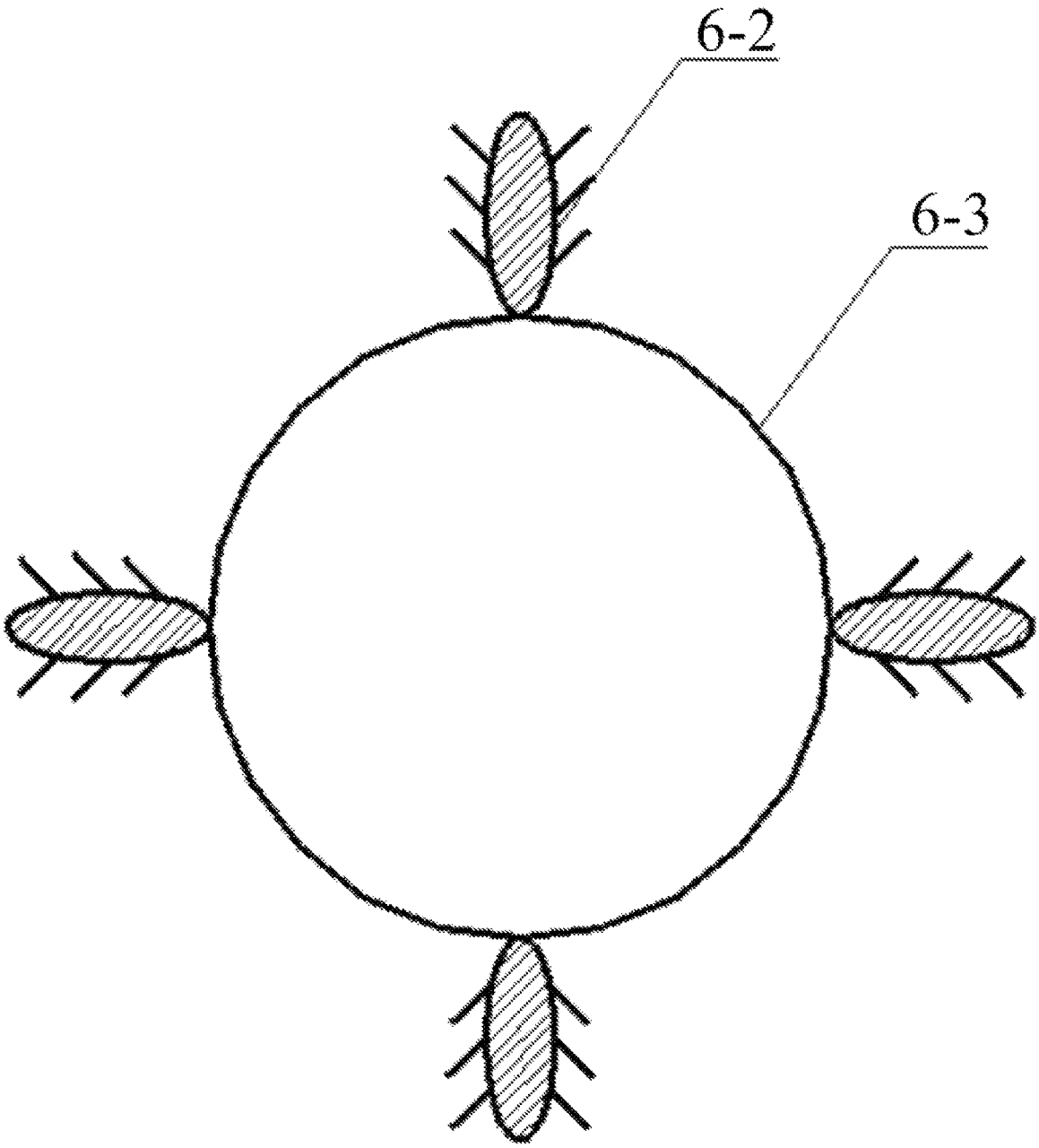
FIG. 13 is another structural diagram of the discharge electrode of the cylindrical IFD filter according to Embodiment 2 of the present invention.
Figure 14:
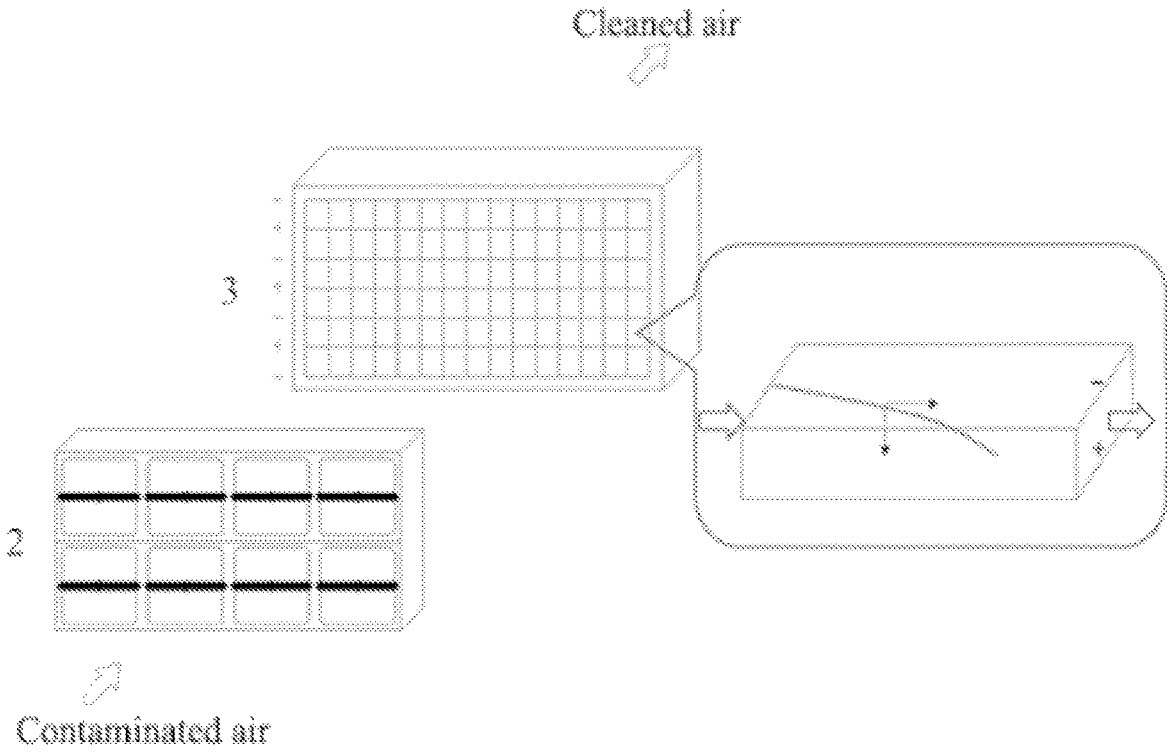
FIG. 14 is a microtechnology schematic diagram of the cylindrical IFD filter according to the present invention.

The working process of the filter according to the present invention is as follows:

As shown in FIG. 2 and FIG. 4, the field power module HVPS supplies power to the discharge electrode conductive ring 6-3 via the field power module cathode 5 so that the field power module anode 4 is charged, a high intensity non-uniform electric field is formed between the discharge electrode 6-2 and said field power module anode 4 so that the discharge electrode 6-2 can be discharged in the discharge cavities 6-1. The particulate contaminants in the air are charged and then entered into said dust collecting module 3 when air flows through the field power module 2. As shown in FIG. 3 and FIG. 5, the dust collecting module HVPS supplies power to the positive plate 9-3 via the dust collecting module anode 7, and the dust collecting module HVPS supplies power to the negative plate 9-4 via the dust collecting module cathode 8, and a high intensity uniform electric field is formed between the positive plate 9-3 and the negative plate 9-4. The air enters into the dust collecting module 9 via the air inlet 9-1, and the charged particulate contaminants are moved toward the positive plate 9-3 under the action of the electric field force and are collected, thus the fresh air exhausts out from the air outlet 9-2. As shown in FIG. 5, the dust collecting module channel 9 is of fan-shape, along the direction from the air inlet 9-1 to the air outlet 9-2, the cross-sectional area is gradually increased and the air flow speed is slower, and the filtering efficiency will improve gradually if the dust collecting voltage does not change, which is more significant for small particles.

Although the present invention has been described above with reference to the accompanying drawings, the present invention is not limited thereto. The present invention can also be applied to the ventilation devices such as air purifiers, fresh air ventilators, etc., which also have the advantages of higher efficiency and less attenuation, and can meet the requirements of inlet air incoming from the middle and outlet air exhausting from the periphery, thus expanding the application scope of the air purifying device.

What is claimed is:

1. A cylindrical intense field dielectric (IFD) filter, comprising (1) a dust collecting module with a first cathode and a first anode, which comprises a middle channel, a side wall with an inner surface, a length and a ring-shaped across-section; and (2) a field power module with a second cathode and a second anode, which is of a cylindrical shape, has a side wall a length same as that of the dust collecting module, and is concentrically disposed inside the middle channel of the dust collection module so that the side wall is facing but not in contact with the inner surface of the dust collecting module; wherein an electric field module comprises a plurality of sub-units each of which comprises a conductive ring, a plurality of discharge cavities formed in the side wall of the electric field module, and a plurality of discharge electrodes welded on the conductive ring and inserted into the discharge cavities, the conductive rings of the sub-units are connected via a metal rod to form the second cathode while a metal rod or wire is connected to the side wall of the field power module form the second anode; and the side wall of the dust collecting module comprises a grid of channels in a plurality of rows and a plurality of columns, each of the channels has a front side being an air inlet and a back side being an air outlet, and the rows of channels are separated from each other by a plurality of ring-shaped plates which are alternatively positive plates and negative plates, with all the positive plates being interconnected by a wire to from the first anode and all the negative plates interconnected by a wire to from the first cathode.

2. The cylindrical IFD filter according to claim 1, wherein the discharge electrodes are of a shape of pointed rod or spiked rod.

3. The cylindrical IFD filter according to claim 1, wherein the discharge cavities are of a round, square or rounded square shape.

4. The cylindrical IFD filter according to claim 3, wherein the conductive ring is sleeved on the field power module.

5. The cylindrical IFD filter according to claim 3, wherein the conductive ring is arranged inside the field power module.

6. The cylindrical IFD filter according to claim 3, wherein the ring-shaped positive plates and negative plates are polar plate electrodes made of a material selected from the group consisting of copper, steel, and aluminum.

7. The cylindrical IFD filter according to claim 6, wherein the polar plate electrodes is coated with a material selected from the group consisting of PVC, PTFE, and ceramic.

* * * * *